US008556394B2

(12) United States Patent
Chen et al.

(10) Patent No.: US 8,556,394 B2
(45) Date of Patent: Oct. 15, 2013

(54) INK SUPPLY

(75) Inventors: Qiong Chen, Singapore (SG); Julita Oentojo, Singapore (SG); Yat Yuen Chan, Singapore (SG); Swei Jen Wong, Singapore (SG)

(73) Assignee: Hewlett-Packard Development Company, L.P., Houston, TX (US)

( * ) Notice: Subject to any disclaimer, the term of this patent is extended or adjusted under 35 U.S.C. 154(b) by 166 days.

(21) Appl. No.: 13/192,282

(22) Filed: Jul. 27, 2011

(65) Prior Publication Data

US 2013/0027479 A1 Jan. 31, 2013

(51) Int. Cl.
*B41J 2/175* (2006.01)

(52) U.S. Cl.
USPC ..... 347/85

(58) Field of Classification Search
USPC ..... 347/84, 85, 88, 93
See application file for complete search history.

(56) References Cited

U.S. PATENT DOCUMENTS

| | | | | |
|---|---|---|---|---|
| 5,165,282 | A | 11/1992 | Nakamura et al. | |
| 6,619,133 | B1 | 9/2003 | Goshoo et al. | |
| 6,629,756 | B2 | 10/2003 | Wang et al. | |
| 6,811,249 | B2 * | 11/2004 | DeVries et al. | 347/85 |
| 7,226,150 | B2 | 6/2007 | Yoshimura et al. | |
| 7,422,316 | B2 * | 9/2008 | Shinada | 347/85 |
| 7,488,058 | B2 * | 2/2009 | Okamoto et al. | 347/84 |
| 7,553,004 | B2 * | 6/2009 | Kachi | 347/85 |
| 7,695,118 | B2 | 4/2010 | Lee et al. | |
| 7,717,548 | B2 * | 5/2010 | Tatsumi et al. | 347/85 |
| 7,829,960 | B2 | 11/2010 | Takizawa | |

FOREIGN PATENT DOCUMENTS

| | | |
|---|---|---|
| JP | 2000141650 | 5/2000 |

* cited by examiner

*Primary Examiner* — Kristal Feggins

(57) ABSTRACT

An ink supply containing an alkaline ink passivates a silicon diaphragm of a pressure sensor against etching from the alkaline ink using a silicon dioxide layer.

8 Claims, 4 Drawing Sheets

INK SUPPLY

BACKGROUND

Some ink supplies utilize pressure sensors having silicon diaphragms to detect remaining ink within a bag. Alkaline inks react with the silicon diaphragm, altering the thickness and create stress at the joints of different crystal planes, which may lead to failure of the sensor.

DETAILED DESCRIPTION OF THE EXAMPLE EMBODIMENTS

Figure 1:
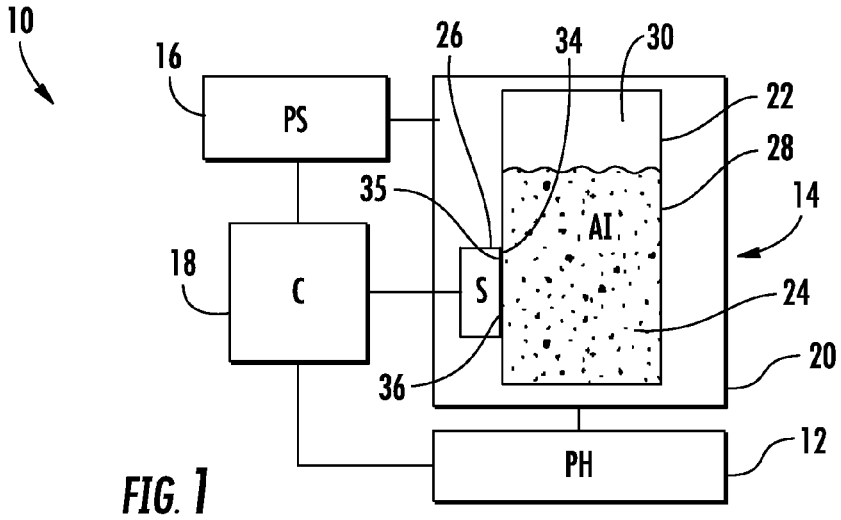
FIG. 1 is a schematic illustration of a printing system according to an example embodiment.

FIG. 1 schematically illustrates printing system 10 according to an example embodiment. Printing system 10 comprises print head 12, ink supply 14, pressure source 16 and controller 18. As will be described hereafter, ink supply 16 supplies an alkaline ink to print head 12 while indicating the remaining amount of ink within the ink supply 16 with a pressure sensor that is less susceptible to damage from the alkaline ink.

Print head 12 comprises one or more print heads configured to receive alkaline ink from ink supply 14 and to selectively eject droplets of the alkaline ink onto a print medium. In one embodiment, print head 12 comprises a thermal resistive print head. In another embodiment, print head 12 comprises a piezo resistive print head. In one embodiment, print head 12 is physically coupled to and carried by ink supply 14, wherein print head 12 and ink supply 14 form a cartridge. In another embodiment, print head 12 may receive alkaline ink from ink supply 14 which serves as an off-axis ink supply. In other embodiments, print head 12 may have other configurations.

Ink supply 14 supplies alkaline ink to print head 12. Ink supply 14 comprises enclosure 20, bag 22, alkaline ink 24 and pressure sensor 26. Enclosure 20 surrounds at least a portion of bag 22 and provides a chamber configured to be pressurized with fluid from pressure source 16 to apply force to bag 22 to squeeze ink 24 from bag 22.

Bag 22 comprises a flexible, compressible or collapsible container within enclosure 20. Bag 22 has an exterior 28 within enclosure 20 and an interior 30 which contains ink 24. Although bag 22 is illustrated as being rectangular, bag 22 may have other sizes, shapes and configurations.

Ink 24 comprises an alkaline ink, a base ink with alkali (in contrast to an acidic ink). Ink 24 is exposed to or in contact with pressure sensor 26.

Pressure sensor 26 comprises a pressure sensing device configured to sense a pressure differential between ink 24 of bag 22 and the exterior 28 of bag 22 within container 20 (the volume between enclosure 20 and bag 22). Pressure sensor 26 has a surface 34 exposed to and in contact with alkaline ink 24 and a second opposite surface 35 exposed to exterior 28 of bag 22 within enclosure 20. Surface 34 is provided by a layer 36 of silicon dioxide. Layer 36 passivates surface 34 and protects sensor 36 from etching, leaching or other corrosion caused by the alkalinity of ink 24. As a result, sensor 26 may have a longer useful life providing more reliable indications of the pressure differential between exterior 28 and ink 24 of bag 22.

In one embodiment, pressure sensor 26 includes a flexible or bendable diaphragm formed from silicon material Si. The silicon dioxide covers or coats a surface of the Si material to block or prevent alkaline ink 24 from contacting the surface of the silicon material. In one embodiment, the layer of silicon dioxide is grown on the silicon material which forms the bendable or flexible portion of the diaphragm. As a result, the diaphragm is less susceptible to stress points and separation between the layer of silicon dioxide and the silicon material. In addition, the silicon dioxide has a more uniform covering over the silicon materials and mixture with SIOx is reduced.

Pressure source 16 comprises a device configured to supply pressurized fluid to exterior 28 within container 20. In one embodiment, pressure source 16 comprises a device configured to supply pressurized gas, such as pressurized air, to the volume between enclosure 20 and bag 22. By pressurizing this volume between enclosure 20 and bag 22, pressure source 16 squeezes or presses upon bag 22 to force alkaline ink from bag 22 to print head 12.

Controller 18 comprises one or more processing units configured to generate control signals controlling print heads 12 and pressure source 16. For purposes of this disclosure, the term "processing unit" shall mean a presently developed or future developed processing unit that executes sequences of instructions contained in a memory. Execution of the sequences of instructions causes the processing unit to perform steps such as generating control signals. The instructions may be loaded in a random access memory (RAM) for execution by the processing unit from a read only memory (ROM), a mass storage device, or some other persistent storage. In other embodiments, hard wired circuitry may be used in place of or in combination with software instructions to implement the functions described. For example, controller 18 may be embodied as part of one or more application-specific integrated circuits (ASICs). Unless otherwise specifically noted, the controller is not limited to any specific combination of hardware circuitry and software, nor to any particular source for the instructions executed by the processing unit.

In the example illustrated, controller 18 is configured to generate control signals for pressure sensor 16 using the sensed pressure differential between interior 30 and exterior 35 as sensed by pressure sensor 26. The control signals direct pressure source 16 to supply fluid under pressure to exterior 28 so as to pressurize bag 22 to squeeze bag 22 to properly dispense and supply the alkaline ink 24 to print heads 12. As noted above, because pressure sensor 26 includes layer 36 which passivates pressure sensor 26 against the corrosive nature of the alkaline ink 24 being dispensed, pressure sensor 26 is less susceptible to damage and may more reliably provide such pressure readings. As a result, the alkaline ink 24 maybe more accurately dispensed.

Figure 2:
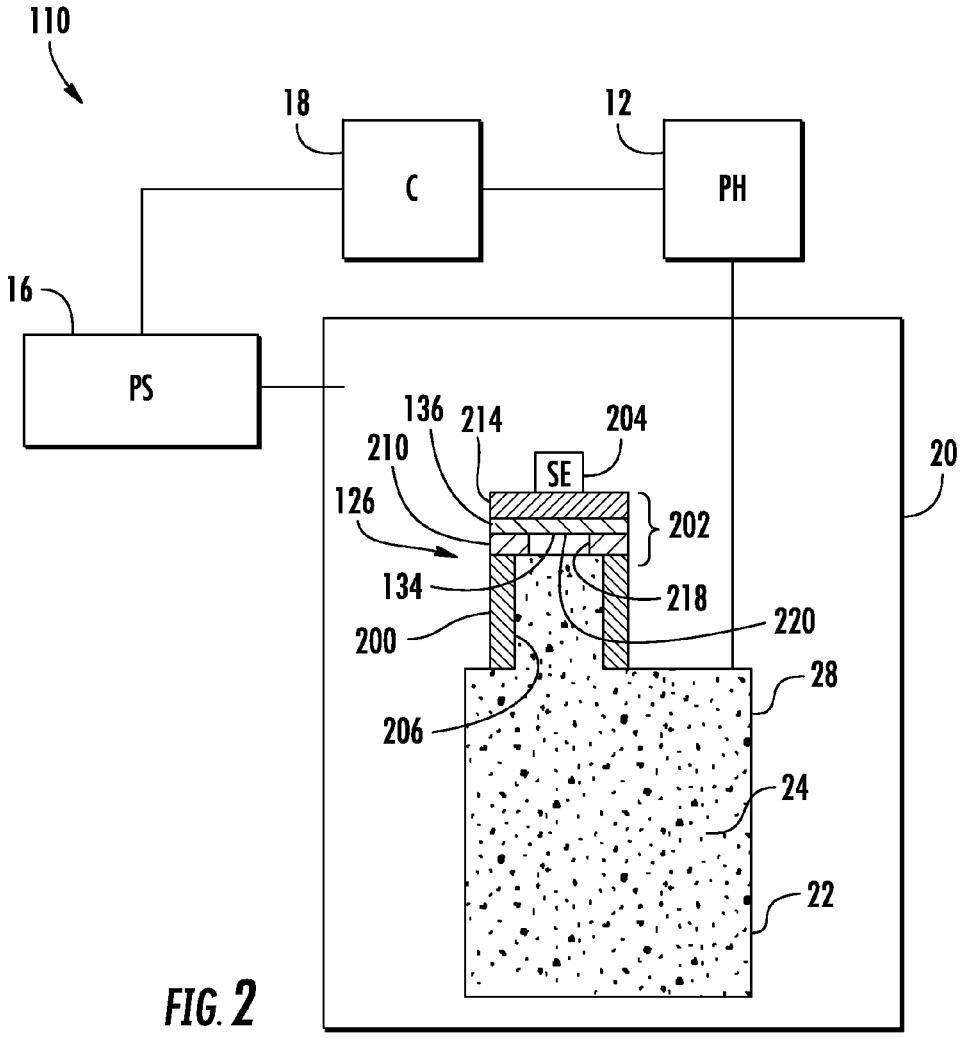
FIG. 2 is a schematic illustration of another embodiment of the printing system of FIG. 1 according to an example embodiment.

FIG. 2 schematically illustrates printing system 110, a particular embodiment of printing system 10. Printing system 110 is similar to printing system 10 except that printing system 110 includes pressure sensor 126, a specific embodiment of pressure sensor 26. Those remaining elements of printing system 110 which correspond to elements of printing system 10 are numbered similarly.

Pressure sensor 126 comprises a pressure sensing device configured to sense a pressure differential between ink 24 of bag 22 and the exterior 28 of bag 22 within container or enclosure 20 (the volume between enclosure 20 and bag 22). Pressure sensor 126 comprises base 200, diaphragm 202 and the sensing element 204. Base 200 comprises one or more structures sandwiched between bag 22 and diaphragm 202, wherein the one or structures at least collectively have a stiffness or rigidity greater than that of the flexible portion of bag 22 so as to support diaphragm 202. In the example illustrated, base 200 comprises one or more layers of glass having a passage 206 providing fluid communication between the interior 30 of bag 22 and diaphragm 202. In other embodiments, base 200 may have other configurations and maybe formed from other materials such as one of more ceramics.

Diaphragm 202 comprises one or more members supported between and in fluid communication with each of ink 24 within interior 30 of bag 22 and exterior 28 of bag 22 between bag 22 and enclosure 20. Diaphragm 202 has portions configured to resilient flex or bend in response to pressure differentials between ink 24 of bag 22 and exterior 28. Diaphragm 202 is configured to resiliently flex or bend in response to changes in such pressure differentials as the alkaline ink 24 is dispensed to print heads 12.

Diaphragm 202 comprises silicon layer 210, silicon layer 214 and silicon dioxide layer 136. Silicon layer 210 comprises a layer of silicon material Si supported by base 200 and underlying silicon dioxide layer 136. Silicon layer 210 includes a passage 218 which extends from passage 206 to face 134 of silicon dioxide layer 136. Passage 218 provides fluid communication between passage 206 and interior 30 to surface 134 of layer 212.

Silicon layer 214 comprises a layer of silicon Si with cooperates with layer 210 to sandwich silicon dioxide layer 136 therebetween. Silicon layer 214 extends across and bridges passage 218 in silicon layer 210 to form a bendable or flexible portion 220 of diaphragm 202. Silicon layer 214 further supports sensing element 204 opposite to passage 218 and opposite to the flexible or bendable portion 220 of diaphragm 202.

Silicon dioxide layer 136 comprises a layer of silicon dioxide covering silicon layer 214 opposite to passage 218. Layer 136 passivates surface 134 and protects silicon layer 214 from etching, leaching or other corrosion caused by the alkalinity of ink 24. As a result, the thickness of the bending or flexible portion 220 of diaphragm 202 formed by layers 136 and 214 opposite to passage 218 does not substantially change as the result of corrosion or leaching. Because the thickness of this bending or flexible portion 220 of diaphragm 202 is more consistent over time, sensor 126 may have a longer useful life providing more reliable indications of the pressure differential between exterior 28 and interior 30 of bag 22.

In the example illustrated, the layer 136 of silicon dioxide is grown on the silicon material of layer 214 which forms the bendable or flexible portion of the diaphragm 202. As a result, the diaphragm 202 is less susceptible to stress points and separation between the layer of silicon dioxide 136 and the silicon material of layer 214. In other embodiments, layer 136 of silicon dioxide may be provided in other fashions.8

Sensing element 204 comprises one or more sensing elements supported at least in part by diaphragm 202 opposite to passage 218 and passage 206. In the example illustrated, sensing element 204 is supported by silicon layer 214. The sensing element 204 is configured to generate distinct or different electrical signals in response to flexing or bending of portion 220 of diaphragm 202. In the example illustrated, sensing element 204 comprises one or more piezoresistive sensing elements. In other embodiments, sensing elements 204 may comprise other types of sensing devices.

Figure 3:
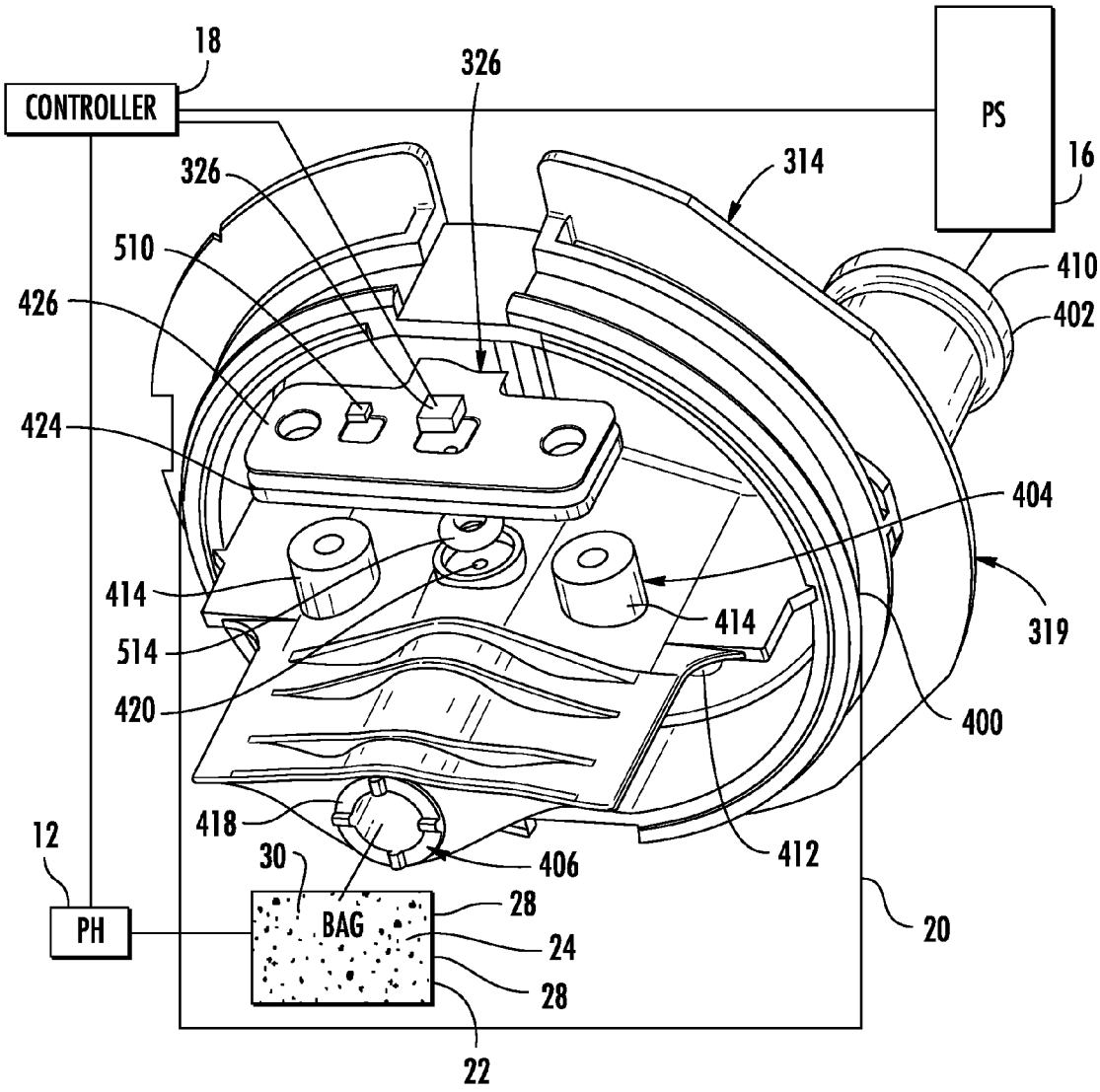
FIG. 3 is a fragmentary perspective view of another embodiment of the printing system of FIG. 1 according to an example embodiment.
Figure 4:
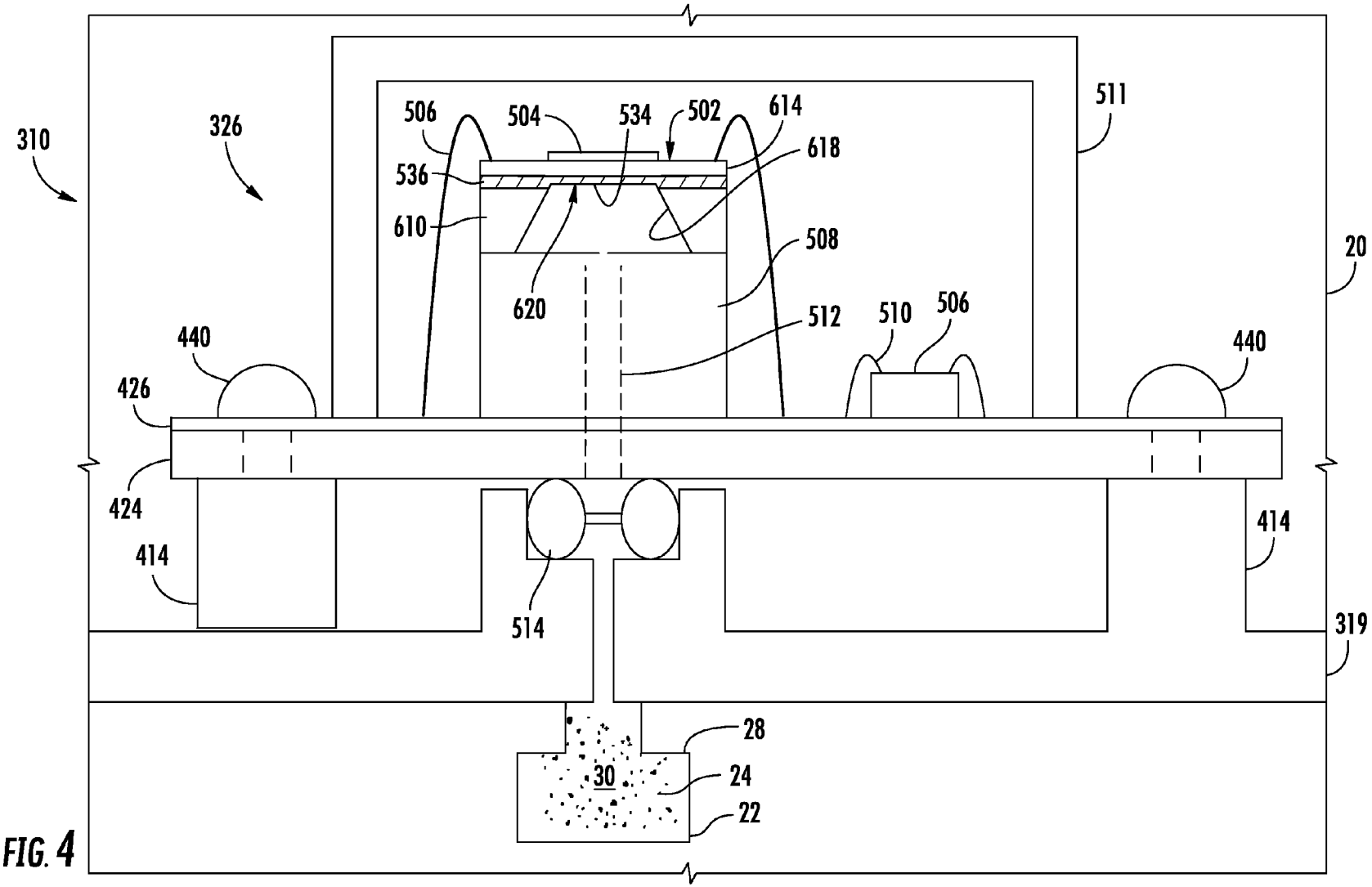
FIG. 4 is a fragmentary sectional view of the printing system of FIG. 3 according to an example embodiment.

FIGS. 3 and 4 illustrate printing system 310, a particular embodiment of printing system 10. Printing system 310 comprises print head 12, pressure source 16, controller 18 (each of which has been described above) and ink supply 314. Ink supply 314 comprises chassis 319, enclosure 20, bag 22, alkaline ink 24 and pressure sensor 326 (each of enclosure 20, bag 22 and ink 24 being schematically shown). Chassis 319 comprises one or more structures extending between enclosure 20 and bag 22 so as to support enclosure 20 and bag 22 relative to one another. Chassis 319 further facilitates fluid communication between pressure source 16 and exterior 28 and fluid communication between interior 30 and pressure sensor 326.

In the example illustrated, chassis 319 comprises a structure having a rim 400, a pressure supply port 402, a pressure sensor mount 404 and a pressure sensor port 406. Rim 400 comprises a structure configured to mate or otherwise seal with enclosure 20. Although illustrated as substantially circular, in other embodiments, rim 400 may have other configurations.

Pressure supply port 402 forms a passage connecting pressure source 16 to exterior 28 of bag 22. Pressure supply port 402 has an inlet 410 connected pressure source 16 exterior of container or enclosure 20 and an outlet 412 communicating with the interior of enclosure 20 exterior to bag 22. In other embodiments, pressure supply port 402 may have other configurations.

Pressure sensor mount 404 comprises one or more structures in the body of chassis 319 configured to facilitate mounting of pressure sensor 326. In the example illustrated, pressure sensor mount 404 comprises a pair of bosses 414 to which pressure sensor 326 is fastened. In other embodiments, pressure sensor mount 404 may have other configurations. For example, in other embodiments where pressure sensor is clipped onto or bonded to chassis 319, pressure sensor mount 414 may comprise other structures and may have other configurations.

Pressure sensor port 406 forms a passage within the body of chassis 319 extending from the interior 30 of bag 22 to pressure sensor 326. Pressure sensor port 406 comprises a first opening 418 connected to the interior 30 of bag 22 and a second opening 420 in communication with pressure sensor 326. In other embodiments, pressure sensor port 46 may have other configurations.

Pressure sensor 326 is mounted to pressure sensor mount 404 and senses a pressure differential between the ink 24 of bag 22 and the exterior 28 of bag 22 between bag 22 and enclosure 20. As shown by FIG. 4, pressure sensor 326 comprises stiffener 424, flexible circuit 426, base 500, diaphragm 502, pressure sensing elements 504, connectors 506, acumen 508, connectors 510 and dust cover 511. Stiffener 424 comprises one or more layers of rigid or stiff materials that support flexible circuit 426 on mounts 414. The one or more layers of stiffener 424 have a collective stiffness and rigidity greater than that of flexible circuit number 426 so as to stiffen flexible circuit 426 and rigidly support flexible circuit 46 and pressure sensor 326. In one embodiment, stiffener 424 comprises one or more layers of ceramic materials. In other embodiments, other relatively stiff materials may be utilized for stiffener 426.

Flexible circuit 426 comprises a flexible circuit having one or more electrical components and electrically conductive traces, facilitating communication of power and data between pressure sensing elements 432 and acumen 436 as well as between such components and controller 18. In the example illustrated, flexible circuit 426 is mounted upon and supported by stiffener 424 and is secured to mounts 414 by fasteners 440 which extend through flexible circuit 426 and stiffener 424 and into engagement with mounts 414.

Base 500 comprises one or more structures sandwiched between circuit 426 and diaphragm 502, wherein the one or structures at least collectively have a stiffness or rigidity greater than that of the diaphragm 502 so as to support diaphragm 430. In the example illustrated, base 500 comprises one or more layers of glass having a passage 512 providing fluid communication between the interior 30 of bag 22 and diaphragm 430. In other embodiments, base 500 may have other configurations and may be formed from other materials such as one of more ceramics.

Passage 512 extends through base 500 and additionally extends through flexible circuit 426 and stiffener 424 to facilitate fluid communication between diaphragm 502 and pressure sensor port 406 of chassis 319 which connects to interior 30 of bag 22. As shown by FIGS. 3 and 4, print system 310 additionally includes a seal 514 sealing between passage 512 and inlet 420 of port 406. In the example illustrated, seal 514 comprises an o-ring. In other embodiments, seal 514 may comprise other sealing structures or members.

Diaphragm 502 comprises one or more members supported between and in fluid communication with the interior 30 of bag 22 and exterior 28 of bag 22 between bag 22 and enclosure 20. Diaphragm 502 has portions configured to resiliently flex or bend in response to pressure differentials between the ink 24 and exterior 28. Diaphragm 502 is configured to resiliently flex or bend in response to changes in such pressure differentials as the alkaline ink 24 is dispensed to print heads 12.

Diaphragm 502 comprises silicon layer 610, silicon layer 614 and silicon dioxide layer 536. Silicon layer 610 comprises a layer of silicon material Si supported by base 500 and underlying silicon dioxide layer 536. Silicon layer 610 includes a cavity or passage 618 which extends from passage 512 to face 534 of silicon dioxide layer 536. Passage 618 provides fluid communication between passage 512 and interior 30 to surface 534 of layer 536.

Silicon layer 614 comprises a layer of silicon Si which cooperates with layer 610 to sandwich silicon dioxide layer 536 therebetween. Silicon layer 614 extends across and bridges passage 618 in silicon layer 610 to form bendable or flexible portion 620 of diaphragm 502. Silicon layer 614 further supports sensing element 504 opposite to passage 618 and opposite to the flexible or bendable portion 620 of diaphragm 502.

Silicon dioxide layer 536 comprises a layer of silicon dioxide covering silicon layer 514 opposite to passage 618. Layer 536 passivates surface 534 and protects silicon layer 614 from etching, leaching or other corrosion caused by the alkalinity of ink 24. As a result, the thickness of the bending or flexible portion 620 of diaphragm 502 formed by layers 536 and 614 opposite to passage 618 does not substantially change as the result of corrosion or leaching. Because the thickness of this bending or flexible portion 620 of diaphragm 502 is more consistent over time, sensor 326 may have a longer useful life providing more reliable indications of the pressure differential between exterior 28 and interior 30 of bag 22.

In the example illustrated, the layer 536 of silicon dioxide is grown on the silicon material of layer 614 which forms the bendable or flexible portion of the diaphragm 502. As a result, the diaphragm 502 is less susceptible to stress points and separation between the layer of silicon dioxide 536 and the silicon material of layer 614. In other embodiments, layer 536 of silicon dioxide may be provided in other fashions.

Sensing element 504 comprises one or more sensing elements supported at least in part by diaphragm 502 opposite to passage 618 and passage 512. In the example illustrated, sensing element 504 is supported by silicon layer 614. The sensing element 504 is configured to generate distinct or different electrical signals in response to be flexing or bending of portion 620 of diaphragm 502. In the example illustrated, sensing element 504 comprises one or more piezoresistive sensing elements. In other embodiments, sensing element 504 may comprise other types of sensing elements.

Connectors 506 comprise electrically conductive wires and electrically conductive traces extending between the one or more sensing element 504 and the flexible circuit 426. Connectors 506 facilitate power and data communication between sensing elements 504 and either acumen 506 or controller 18 (shown in FIG. 3). In other embodiments, connectors 506 may have other configurations.

Acumen 508 comprises an on-board computer chip with a persistent memory or storage device communicatively connected to flexible circuit 426 and one or both of pressure sensor 326 or controller 18 by electrical connectors 510 which comprise electrically conductive data transmitting wires or electrically conductive traces. Acumen 508 is configured to store data regarding ink supply 14. For example, acumen 508 is configured to store either sensed pressure differential measurements taken by pressure sensor 326 or data regarding the estimated remaining amount of ink within bag 22. In other embodiments, acumen 508 may store additional information. In some embodiments, acumen 508 may be omitted.

Dust cover 511 comprises a cover extending from flexible circuit 4 to 6 over and about diaphragm 502, pressure sensing elements 504 and acumen 506. Cover 511 protects such components from airborne contamination. In other embodiments, dust cover 511 may be omitted.

Figure 5A:
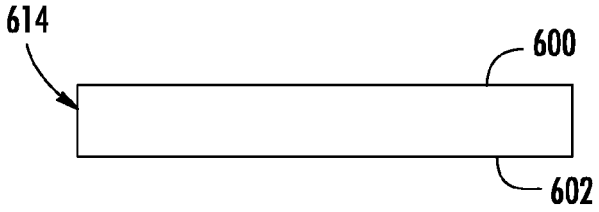
FIGS. 5A-5E are sectional views schematically illustrating a method for forming a diaphragm of a pressure sensor of the printing system of FIG. 4 according to an example embodiment.

FIGS. 5A-5D illustrate one example method for forming diaphragm 502. As shown by FIG. 5A, silicon layer 514 is provided. Silicon layer 514 has a first side 600 and a second opposite side 602. In the example illustrated, silicon layer 514 has a thickness of approximately 10 μm. In other embodiments, silicon layer 514 may have other thicknesses.

Figure 5B:
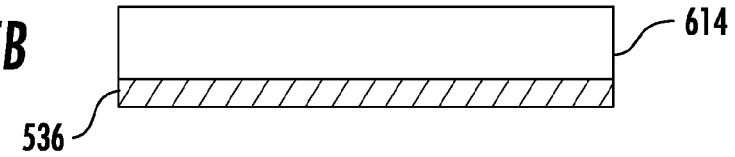

As shown by FIG. 5B, silicon dioxide layer 536 is joined directly to side 602 of silicon layer 514. In the example illustrated, silicon dioxide layer 536 is grown upon surface or side 602. Silicon dioxide layer 536 has a thickness of between about 750 Å and about 1250 Å and nominally 1000 Å. Because layer 536 is grown upon surface 602, the diaphragm 502 is less susceptible to stress points and separation between the layer of silicon dioxide 536 and the silicon material of layer 614. In other embodiments, layer 536 of silicon dioxide may be provided in other fashions.

Figure 5C:
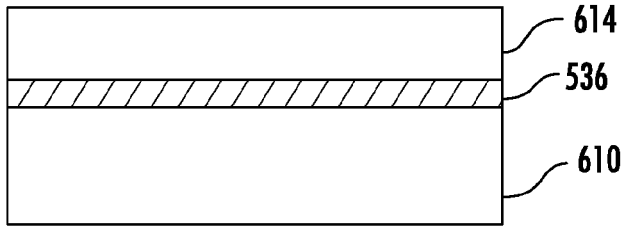

As shown by FIG. 5C, silicon layer 610 is joined to silicon dioxide layer 536 such that silicon dioxide layer 536 is sandwiched between layers 610 and 614. In one embodiment, silicon layer 610 is bonded or adhered to layer 536. In the example illustrated, silicon layer 610 has a thickness of about 300μ. In other embodiments, silicon layer 610 may have other thicknesses as silicon layer 610 does not impact the flexibility of diaphragm 502.

Figure 5D:
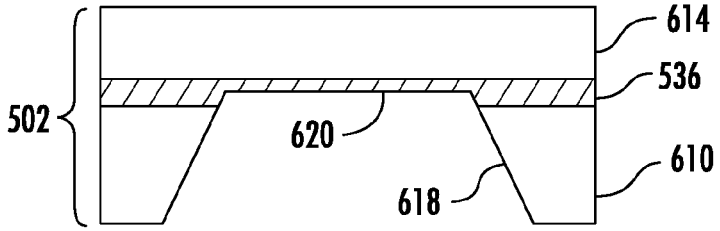

As shown by FIG. 5D, a portion of layer 610 is removed to form passage 618, exposing silicon dioxide layer 536 to form the flexible or bendable portion 620 of diaphragm 502. In the example illustrated, the portion is removed through etching. In the example illustrated, a slight undercut in the silicon dioxide layer is formed, wherein a drop in current indicates that sufficient etching has been completed. In other embodiments, the noted portion of layer 610 may be removed using other material removal techniques. In the example illustrated, the resulting diaphragm 502 has a thickness of approximately 300μ.

Figure 5E:
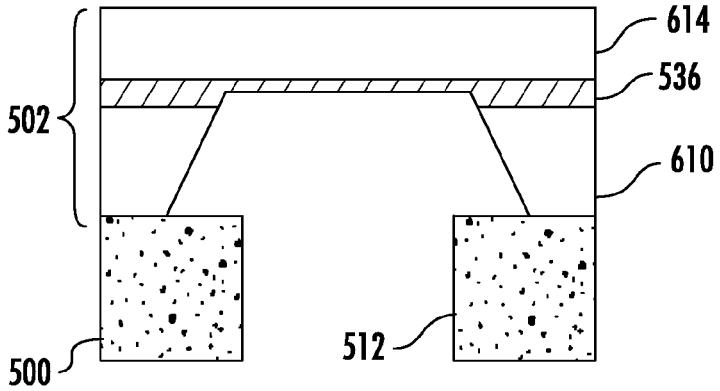

As shown by FIG. 5E, the resulting diaphragm 502 is mounted upon base 500 with passage 618 aligned with passage 512. The resulting assembly of diaphragm 502 and base 500 has a thickness of approximately 800μ. The resulting assembly is subsequently mounted to flexible circuit 426 and stiffer 424 (shown in FIG. 4). The alkaline ink within bag 22 comes into contact with silicon dioxide layer 536 through passages 512 and 618. In the example illustrated, passage 512 has a width or diameter of approximately 750μ. In other embodiments, passage 512 may have other dimensions.

As noted above, layer 536 passivates surface 534 and protects silicon layer 614 from etching, leaching or other corrosion caused by the alkalinity of ink 24 (shown in FIG. 3). As a result, the thickness of the bending or flexible portion 620 of diaphragm 502 formed by layers 536 and 614 opposite to passage 618 does not substantially change as the result of corrosion or leaching. Because the thickness of the bendable or flexible portion 620 of diaphragm 502 is more consistent over time, sensor 326 may have a longer useful life, providing more reliable indications of the pressure differential between exterior 28 and interior 30 of bag 22.

Although the present disclosure has been described with reference to example embodiments, workers skilled in the art will recognize that changes may be made in form and detail without departing from the spirit and scope of the claimed subject matter. For example, although different example embodiments may have been described as including one or more features providing one or more benefits, it is contemplated that the described features may be interchanged with one another or alternatively be combined with one another in the described example embodiments or in other alternative embodiments. Because the technology of the present disclosure is relatively complex, not all changes in the technology are foreseeable. The present disclosure described with reference to the example embodiments and set forth in the following claims is manifestly intended to be as broad as possible. For example, unless specifically otherwise noted, the claims reciting a single particular element also encompass a plurality of such particular elements.

What is claimed is:

1. An ink supply comprising:
an enclosure;
a bag within the enclosure;
an alkaline ink within the bag;
a pressure sensor configured to sense a pressure differential between an interior of the bag and an exterior of the bag within the enclosure, the pressure sensor having a surface exposed to and in contact with the alkaline ink, wherein the surface is passivated against etching by the alkaline ink with silicon dioxide.

2. The ink supply of claim 1 further comprising:
a chassis,
wherein the sensor further comprises:
a diaphragm between the interior and the exterior, the diaphragm comprising:
a first silicon layer;
a second silicon layer; and
the silicon dioxide layer sandwiched between the first silicon layer and the second silicon layer;
a passage on a first side of the silicon dioxide layer and extending from an interior of the bag through the second silicon layer to the silicon dioxide layer; and
a piezoresistive sensing element on the diaphragm.

3. The ink supply of claim 2, wherein the silicon dioxide layer is grown upon the first silicon layer.

4. The ink supply of claim 2, further comprising:
a stiffener coupled to the chassis;
the flexible circuit supported by the stiffener;
a base supported by the flexible circuit, wherein the sensor is on the base and wherein the passage extends through the stiffener, flexible circuit and the base.

5. The ink supply of claim 2, further comprising an undercut extending into the silicon dioxide layer adjacent the passage.

6. The ink supply of claim 2, wherein the silicon dioxide layer has a thickness of between 750μ and 1250μ.

7. The ink supply of claim 1, wherein the silicon dioxide layer has a thickness of between 750μ and 1250μ.

8. The ink supply of claim 1, wherein the silicon dioxide layer is part of a diaphragm, wherein the silicon dioxide layer is sandwiched between a first silicon layer and a second silicon layer, wherein the silicon dioxide layer is exposed to the alkaline ink by a passage extending through the second silicon layer and is grown on the first silicon layer.

* * * * *